US006788167B2

(12) United States Patent
Okada et al.

(10) Patent No.: US 6,788,167 B2
(45) Date of Patent: Sep. 7, 2004

(54) DIELECTRIC FILTER, DIELECTRIC DUPLEXER, AND COMMUNICATION APPARATUS INCORPORATING THE SAME

(75) Inventors: Takahiro Okada, Ishikawa-ken (JP); Jinsei Ishihara, Kanazawa (JP); Hideyuki Kato, Ishikawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 09/919,517

(22) Filed: Jul. 31, 2001

(65) Prior Publication Data

US 2002/0017967 A1 Feb. 14, 2002

(30) Foreign Application Priority Data

Aug. 7, 2000 (JP) ..... 2000-239056

(51) Int. Cl.[7] ..... H01P 5/12; H01P 1/20
(52) U.S. Cl. ..... 333/134; 333/202; 333/206
(58) Field of Search ..... 333/134, 202, 333/206

(56) References Cited

U.S. PATENT DOCUMENTS

| | | | | | |
|---|---|---|---|---|---|
| 4,673,902 | A | * | 6/1987 | Takeda et al. | 333/202 |
| 4,879,533 | A | | 11/1989 | De Muro et al. | |
| 5,173,672 | A | * | 12/1992 | Heine | 333/206 |
| 5,374,909 | A | | 12/1994 | Hirai et al. | 333/201 |
| 5,721,520 | A | * | 2/1998 | McVeety et al. | 333/202 |
| 5,764,118 | A | * | 6/1998 | Saito et al. | 333/206 |
| 5,793,267 | A | * | 8/1998 | Tada et al. | 333/202 |
| 5,905,420 | A | * | 5/1999 | Tsujiguchi et al. | 333/134 |
| 5,949,308 | A | * | 9/1999 | Hino | 333/202 |
| 6,008,707 | A | * | 12/1999 | Tada et al. | 333/134 |
| 6,020,800 | A | | 2/2000 | Arakawa et al. | 333/208 |
| 6,087,911 | A | * | 7/2000 | Tada et al. | 333/206 |
| 6,351,198 | B1 | * | 2/2002 | Tsukamoto et al. | 333/134 |

FOREIGN PATENT DOCUMENTS

| | | | |
|---|---|---|---|
| CN | 1036667 | A | 10/1989 |
| CN | 1192592 | A | 9/1998 |
| EP | 0563987 | | 10/1993 |
| EP | 0820115 | | 1/1998 |
| EP | 0 863 566 | A1 | 9/1998 |
| EP | 0986124 | | 3/2000 |
| JP | 6-97705 | | 4/1994 |
| JP | 8-65009 | | 3/1996 |
| JP | 10-163708 | | 6/1998 |
| JP | 11-205014 | | 7/1999 |

OTHER PUBLICATIONS

Article "Novel Dielectric Waveguide Components—Microwave Applications of New Ceramic Materials" Proceedings of the IEEE, IEEE, New York \, US, vol. 79, No. 6, Jun. 1, 1991.

Copy of The People's Republic of China Office Action dated Jan. 31, 2003 (and English translation of same).

Copy of Japanese Examination Report dated Mar. 30, 2004 (and English translation of same).

* cited by examiner

*Primary Examiner*—James H. Cho
(74) *Attorney, Agent, or Firm*—Dickstein, Shapiro, Morin & Oshinsky, LLP.

(57) ABSTRACT

A dielectric filter capable of easily obtaining desired filter characteristics by strongly coupling mutually adjacent resonators with high accuracy even when reducing the height of the entire filter. In this filter, inside a dielectric block, there are disposed inner-conductor-formed holes in which inner conductors are formed on the inner surfaces of the holes. Coupling electrodes are arranged on an outer surface of the dielectric block and are electrically connected to the inner conductors. Additionally, the coupling electrodes are extended, for example, from the edge of an opening surface of the dielectric block which contains the open ends of the inner-conductor-formed holes, onto a side surface which is disposed parallel to a direction in which the inner-conductor-formed holes are aligned. The invention also provides a duplexer and a communication apparatus using the dielectric filter.

7 Claims, 7 Drawing Sheets

DIELECTRIC FILTER, DIELECTRIC DUPLEXER, AND COMMUNICATION APPARATUS INCORPORATING THE SAME

BACKGROUND OF THE INVENTION

1. Field of the Invention

The present invention relates to dielectric filters including dielectric blocks having inner conductors formed therein and outer conductors formed thereon, dielectric duplexers, and communication apparatuses incorporating the same.

2. Description of the Related Art

A conventional dielectric filter using a dielectric block is shown in each of FIGS. 9A and 9B. FIG. 9A shows a perspective view of the dielectric filter and FIG. 9B shows a view of the open face side of inner conductors. In each of FIGS. 9A and 9B, the reference numeral 1 denotes a rectangular parallelepiped dielectric block. Inside the dielectric block 1, there are arranged inner-conductor-formed holes 2*a* and 2*b* in which inner conductors are formed on the inner surfaces thereof. On a surface of the dielectric block 1 at open ends holes 2*a* and 2*b*, there are formed coupling electrodes 3*a* and 3*b* connected to the inner conductors. An outer conductor 4 is formed on the remaining five surfaces of the dielectric block 1.

With the above arrangement, there are provided two resonators formed in the dielectric block. The two resonators are coupled via a capacitance generated between the coupling electrodes 3*a* and 3*b*.

In order to broaden the pass band of a band pass filter having a plurality of resonators formed in a dielectric block, the coupling strength between the resonators needs to be increased. As shown in FIGS. 9A and 9B, in the conventional dielectric filter, the coupling electrodes are disposed on the end face of the dielectric block at the open ends of the inner conductors. In order to increase the coupling strength between the resonators, the gap g between the coupling electrodes 3*a* and 3*b* needs to be narrowed. On the other hand, on the end face of the dielectric block, where the open ends of the inner-conductor-formed holes are formed, when determining the gap between the coupling electrodes connected to the adjacent inner conductors, even with the use of the narrowest gap obtainable with the accuracy range available for forming electrode patterns, there is a limitation to the amount of capacitance that can be generated between the coupling electrodes 3*a* and 3*b*.

Thus, as shown in FIG. 9C, by arranging mutually opposing portions of the coupling electrodes 3*a* and 3*b* in comb-like forms, a relatively large capacitance can be generated in the limited area. However, in order to make such electrode patterns, the electrode-pattern forming method requires high accuracy. As a result, it is difficult to obtain a dielectric filter having good characteristics. Thus, this causes reduced yield rates and an increase in cost.

Furthermore, with the demand for miniaturized communication apparatuses incorporating dielectric filters using such dielectric blocks, the heights of the components used are reduced, so the length of the space (indicated by the symbol h in the figure) between the coupling electrodes cannot be increased. Consequently, since the magnitude of an obtained coupling strength is limited, it is difficult to produce a dielectric filter having a desired bandwidth. In other words, height reduction is eventually limited due to conditions for the coupling strength between resonators to be coupled.

SUMMARY OF THE INVENTION

Accordingly, the present invention provides a dielectric filter capable of easily obtaining desired filter characteristics by strongly coupling adjacent resonators with high accuracy while reducing the height of the entire filter. In addition, the invention provides a dielectric duplexer and a communication apparatus incorporating the filter or the duplexer.

According to a first aspect of the present invention, there is provided a dielectric filter including a substantially rectangular parallelepiped dielectric block. The coupling electrodes are having a plurality of inner-conductor-formed holes arranged thereinside. There are inner conductors disposed on the inner surfaces of the holes. In addition, the filter includes coupling electrodes formed on an outer surface of the dielectric block. The coupling electrodes are extended either to a first edge of the dielectric block at which a surface which contains open ends of the inner-conductor-formed holes joins a side surface parallel to a direction in which the holes are aligned, or onto said side surface across said first edge. The coupling electrodes are connected to the inner conductors. An outer conductor is arranged on outer surfaces of the dielectric block. With this arrangement, a large capacitance can be generated between the coupling electrodes.

Furthermore, this filter may further include input/output electrodes arranged on a side surface opposing the first mentioned side surface from a second edge opposing the first edge, to generate capacitances between the open end portions of the inner conductors and the input/output electrodes. With this arrangement, in the state in which the input/output electrodes are connected to electrodes on a mounting circuit board, the coupling electrodes are positioned on the upper surface of the dielectric block so that the electrode patterns do not influence the coupling strength between the resonators inside the dielectric block.

According to a second aspect of the invention, there is provided a dielectric duplexer including the input/output electrodes of the dielectric filter according to the first aspect. The input/output electrodes are used as a transmission-signal input electrode, a reception-signal output electrode, and an antenna-connecting electrode.

Additionally, according to a third aspect of the invention, there is provided a communication apparatus including one of the dielectric filter and the dielectric duplexer. For example, the dielectric filter or the dielectric duplexer is incorporated in a filter circuit for filtering transmission signals and reception signals in a high frequency circuit section.

Other features and advantages of the present invention will become apparent from the following description of embodiments of the invention which refers to the accompanying drawings.

DETAILED DESCRIPTION OF EMBODIMENTS OF THE INVENTION

Figure 1A:
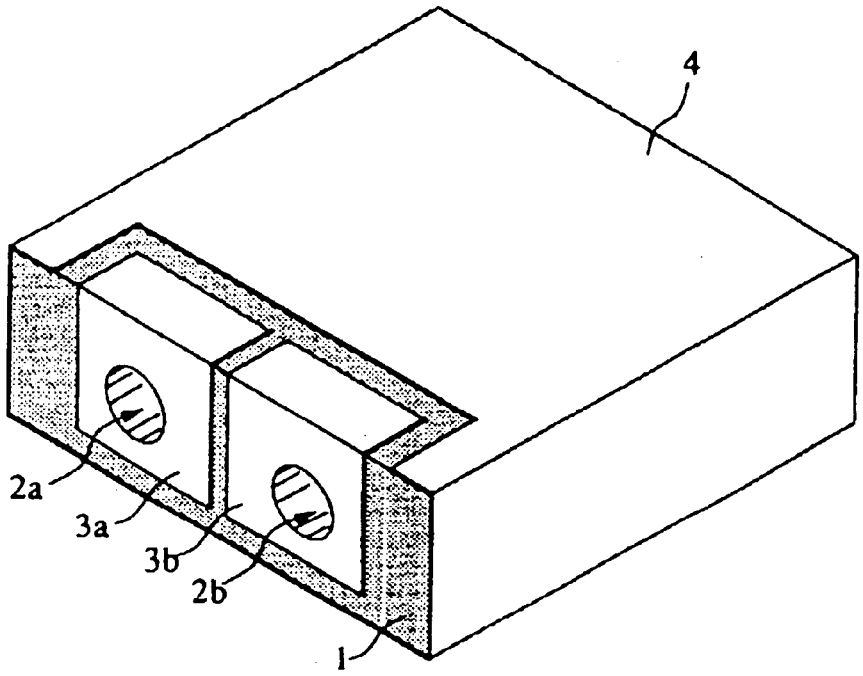
FIGS. 1A and 1B show perspective views illustrating a dielectric filter according to a first embodiment of the present invention.
Figure 1B:
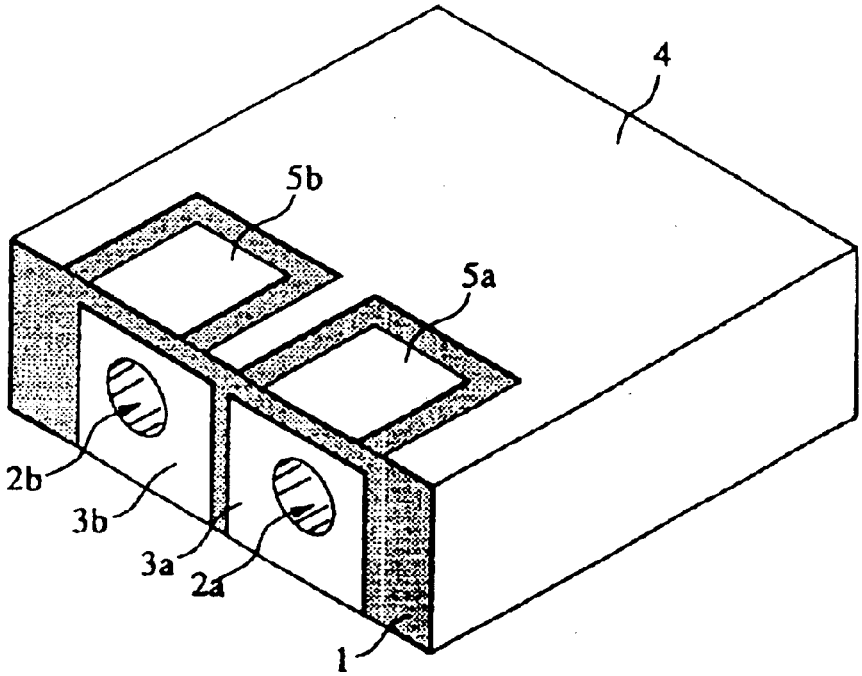
Figure 2:
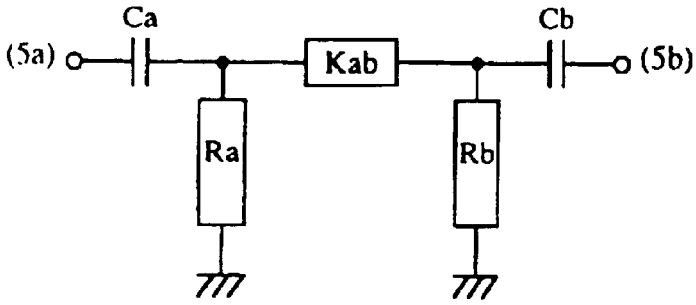
FIG. 2 shows an equivalent circuit diagram of the dielectric filter.

With reference to FIGS. 1A and 1B and FIG. 2, a description will be given of a dielectric filter according to a first embodiment of the present invention.

FIG. 1A shows a perspective view of the dielectric filter mounted on a mounting substrate (not shown). FIG. 1B shows a perspective view of the dielectric filter turned upside down. The reference numeral 1 denotes a substantially rectangular parallelepiped dielectric block. Inside the dielectric block 1, there are arranged inner-conductor-formed holes 2*a* and 2*b* in which inner conductors are formed on the inner surfaces. On one end surface of the dielectric block at open ends of the inner-conductor-formed holes 2*a* and 2*b*, that is, on the front left end face in the figure, there are arranged coupling electrodes 3*a* and 3*b* connected to the inner conductors. In addition, the coupling electrodes 3*a* and 3*b* are extended onto a side surface (the upper surface shown in FIG. 1A) parallel to the axes of the inner-conductor-formed holes 2*a* and 2*b* of the dielectric block 1.

In addition, on a mounting surface (the upper surface shown in FIG. 1B) of the dielectric filter for being opposed to a mounting substrate, there are arranged input/output electrodes 5*a* and 5*b*, which capacitively couple with the open end portions of the inner conductors formed on the inner surfaces of the inner-conductor-formed holes 2*a* and 2*b*. Furthermore, on outer surfaces (five surfaces) of the dielectric block 1 there is arranged an outer conductor 4 insulated from the coupling electrodes 3*a* and 3*b* and the input/output electrodes 5*a* and 5*b*.

FIG. 2 shows an equivalent circuit diagram of a dielectric filter shown in FIGS. 1A and 1B. In this figure, the reference numerals Ra and Rb denote ¼ wavelength resonators formed by the inner conductors of the inner-conductor-formed holes 2*a* and 2*b* formed in the dielectric block 1 and the outer conductor 4 formed thereon. Each resonator has a short-circuited end and an open-circuited end. The reference character Kab denotes a coupling impedance between the two resonators Ra and Rb. The reference characters Ca and Cb denote capacitances between parts near the open ends of the inner conductors and the input/output electrodes 5*a* and 5*b*. The arrangement described above provides the dielectric filter having band pass characteristics, in which the two resonators are coupled each other. The pass bandwidth is determined by the coupling strength between the two resonators Ra and Rb. Since the coupling electrodes 3*a* and 3*b* are extended from the opening surface of the inner-conductor-formed holes to the side surface thereof, without either greatly narrowing the gap between the coupling electrodes or arranging the electrodes in comb-like forms, a large capacitance can be generated between the input/output electrodes 3*a* and 3*b*. Thus, with no need for high accuracy in the electrode patterns, the dielectric filter having desired filter characteristics can be produced having a high yield rate.

When mounting the dielectric filter shown in FIGS. 1A and 1B on the mounting substrate, the input/output electrodes 5*a* and 5*b* are connected to electrode pads on the mounting substrate and the outer conductor 4 is connected to grounding patterns on the mounting substrate. In this situation, the coupling electrodes 3*a* and 3*b* are spaced away from the electrodes on the mounting substrate. Thus, the electrodes on the mounting substrate have no influence on the coupling between the resonators.

Figure 3A:
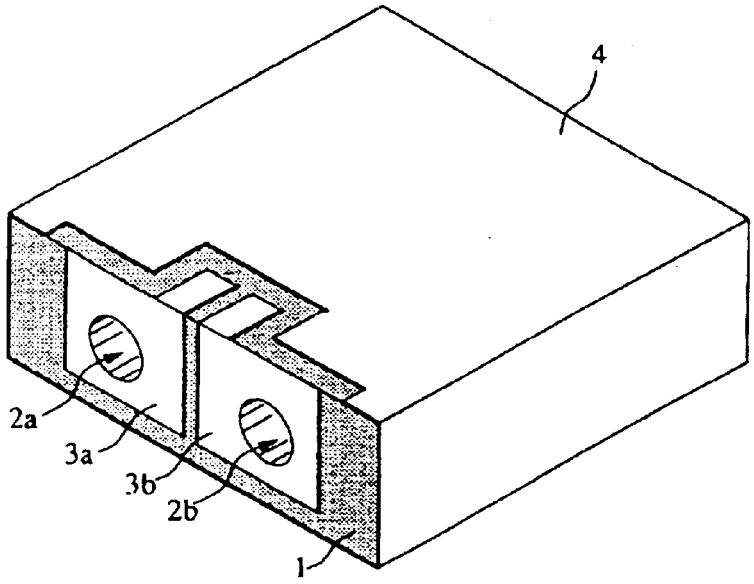
FIGS. 3A and 3B show perspective views illustrating a dielectric filter according to a second embodiment of the invention.
Figure 3B:
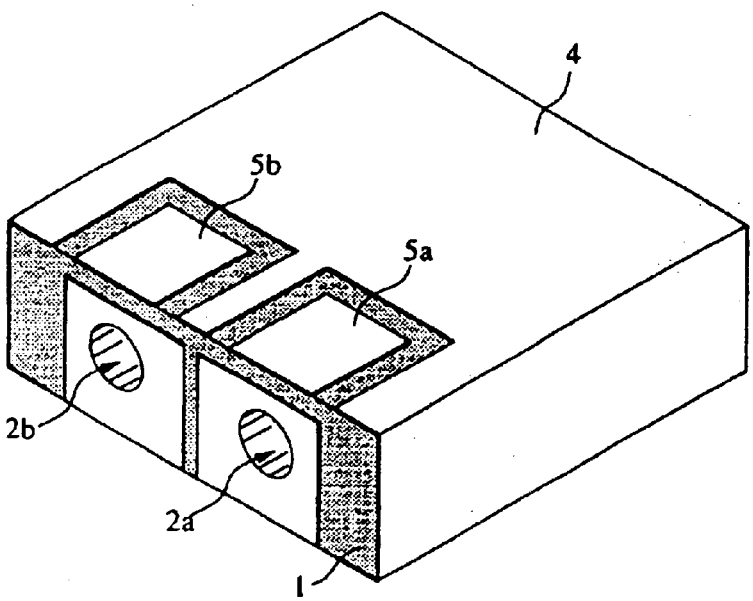

Next, FIGS. 3A and 3B show perspective views illustrating a dielectric filter according to a second embodiment of the invention. FIG. 3A shows a perspective view of the dielectric filter mounted on the substrate and FIG. 3B shows a perspective view illustrating the dielectric filter turned upside down. In this case, parts of the coupling electrodes 3*a* and 3*b* are extended to the edge of the end surface of the dielectric block containing the open ends of the inner-conductor-formed holes. In addition, only the mutually opposing parts of the electrodes 3*a* and 3*b* are extended onto a side surface parallel to the axes of the inner-conductor-formed holes 2*a* and 2*b* from the open end surface of the holes. The remaining structural parts are the same as those of the dielectric filter shown in FIGS. 1A and 1B.

In this embodiment, parts contributory to obtaining a large capacitance between the coupling electrodes are the gaps at which the electrodes are opposed to each other. Thus, even with the electrodes arranged in the above manner, there can be obtained the same characteristics as those shown in FIGS. 1A and 1B.

Figure 4A:
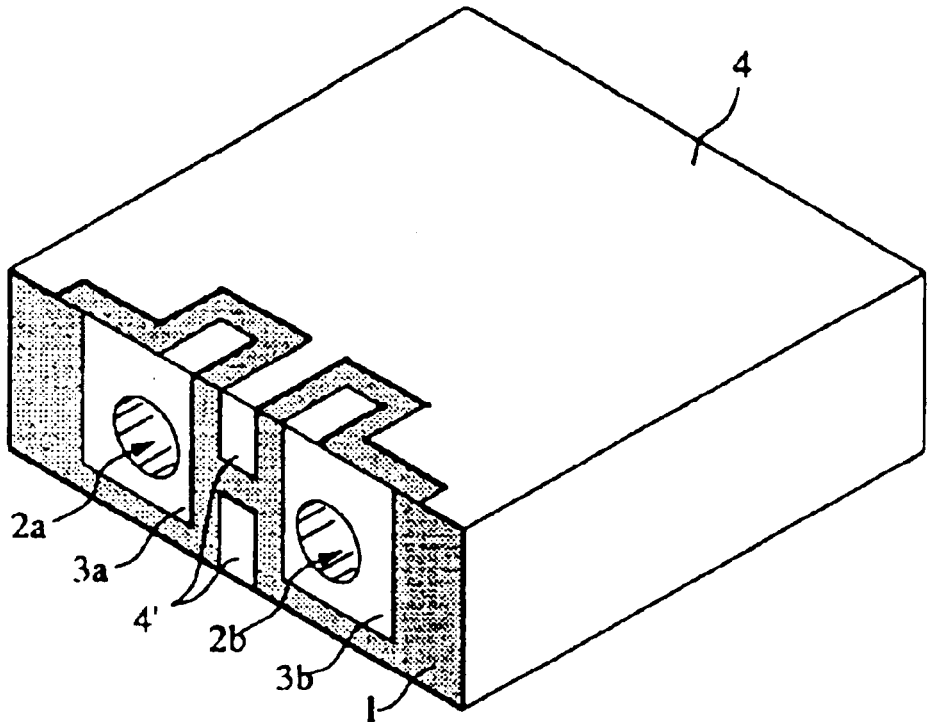
FIGS. 4A and 4B show perspective views illustrating a dielectric filter according to a third embodiment of the invention.
Figure 4B:
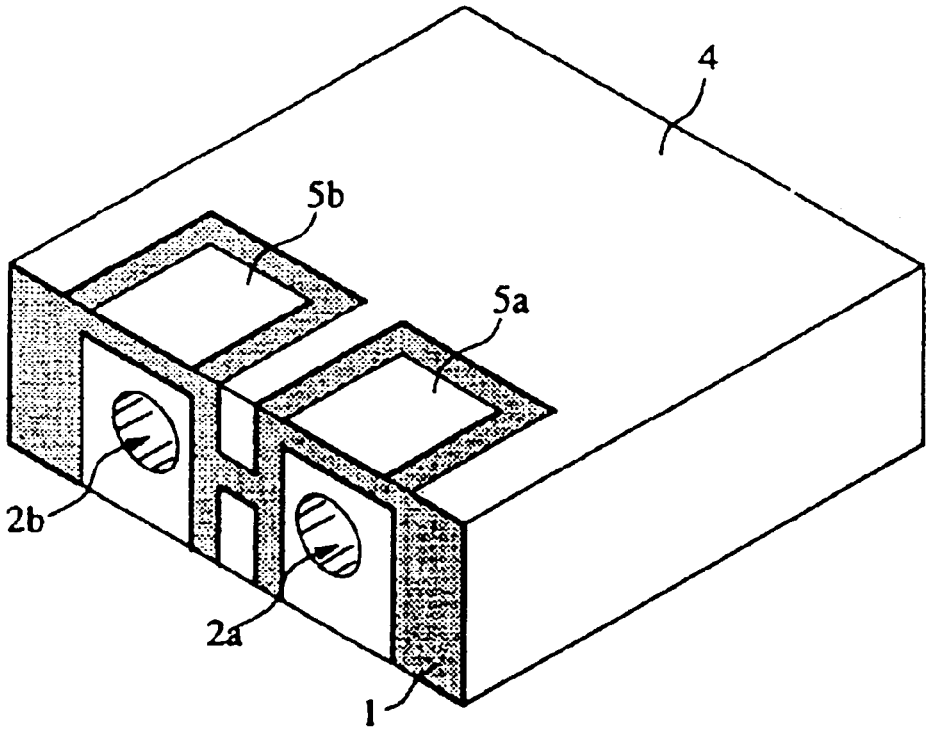

Next, FIGS. 4A and 4B show perspective views of a dielectric filter according to a third embodiment of the invention. FIG. 4A shows a perspective view of the dielectric filter mounted on a substrate and FIG. 4B shows a perspective view of the filter turned upside down. The entire structure of the dielectric filter is similar to the structure of the filter shown in FIGS. 3A and 3B. However, unlike the filter shown in FIGS. 3A and 3B, outer conductors 4' which extend from the outer conductors 4 are formed between the two coupling electrodes 3*a* and 3*b* and the two input/output electrodes 5*a* and 5*b*. As a result, in this embodiment, capacitances generated between the coupling electrodes 3*a* and 3*b* and the outer conductors 4 and 4' are formed at the open ends of the resonators as top-end capacitances. With this arrangement, the resonators inductively couple with each other. In addition, adding the top-end capacitances lowers the resonance frequency. The top-end capacitances can be increased by extending parts of the coupling electrodes 3*a* and 3*b* onto a side surface of the dielectric block 1. Accordingly, the physical lengths of the resonators, that is, the axial lengths of the inner-conductor-formed holes 2*a* and 2*b*, can be decreased. Thus, the entire filter can be miniaturized.

Figure 5A:
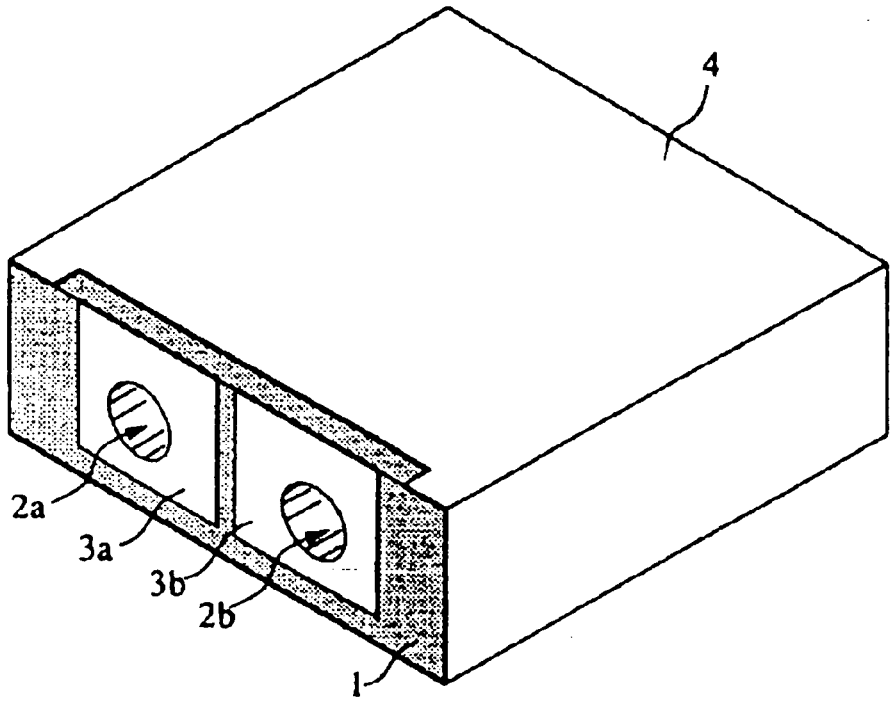
FIGS. 5A and 5B show perspective views illustrating a dielectric filter according to a fourth embodiment of the invention.
Figure 5B:
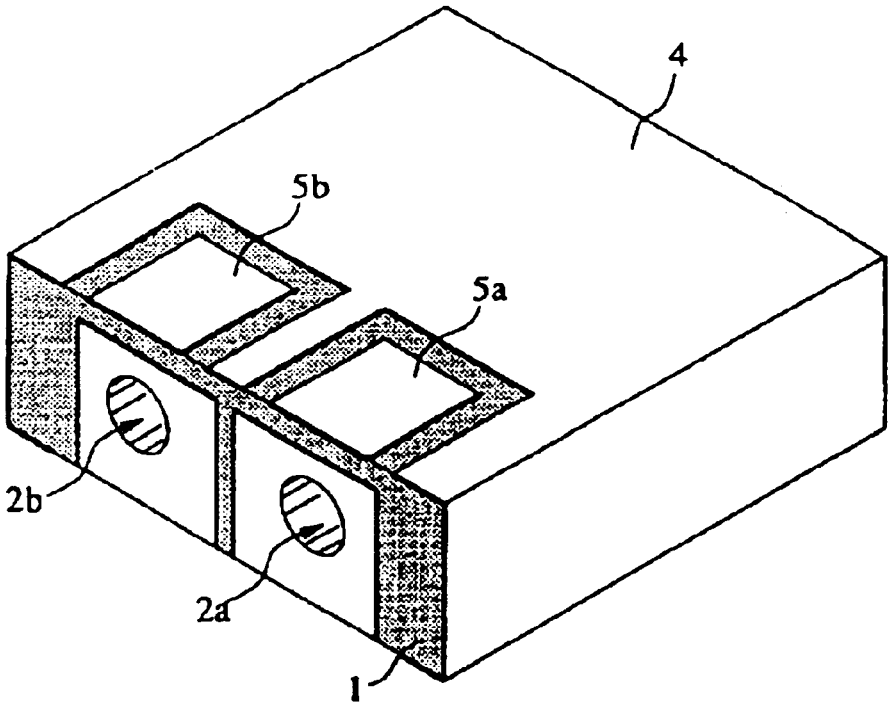

Next, FIGS. 5A and 5B show perspective views of a dielectric filter according to a fourth embodiment of the invention. In this embodiment, coupling electrodes 3*a* and 3*b* are extended to the edge of the open surface of inner-conductor-formed holes 2*a* and 2*b*. In addition to this, there is provided a gap between the edge and the outer conductor 4 so that the outer conductor 4 is not connected to the coupling electrodes 3*a* and 3*b* extended to the edge. The remaining structural parts are the same as those shown in FIGS. 1A and 1B.

As shown above, in the structure in which the coupling electrodes 3*a* and 3*b* are not extended onto the side surface of the dielectric block, when compared with the dielectric filter shown in FIGS. 1A and 1B, the capacitance between the coupling electrodes becomes smaller. Nevertheless, the coupling between the resonators can be stronger than the coupling between the resonators in the conventional dielectric filter.

Figure 9A:
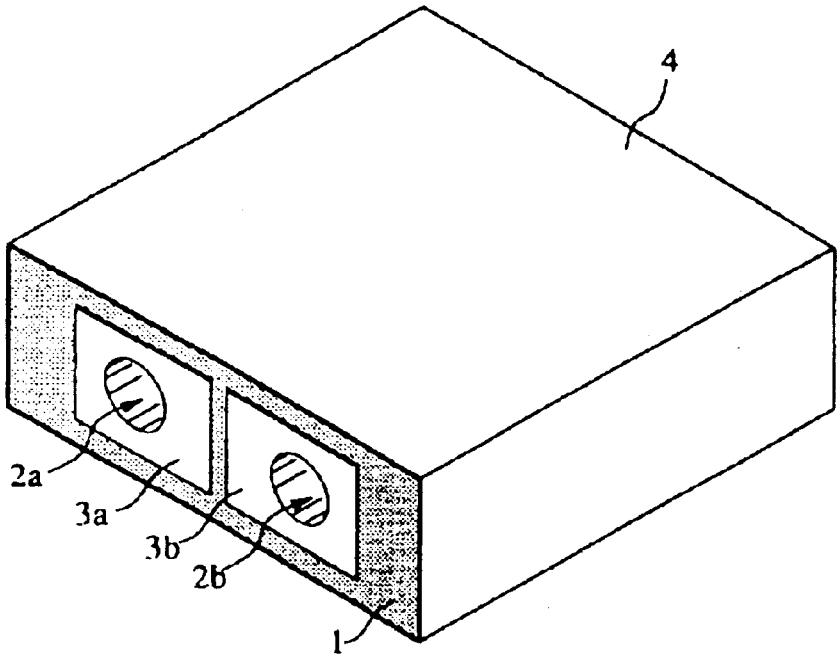
FIG. 9A Prior Art
FIGS. 9A to 9C show perspective views illustrating the structure of a conventional dielectric filter.
Figure 9B:
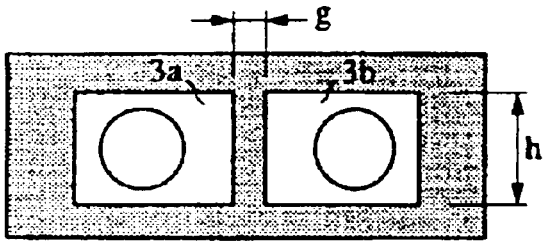
FIG. 9B Prior Art
Figure 9C:
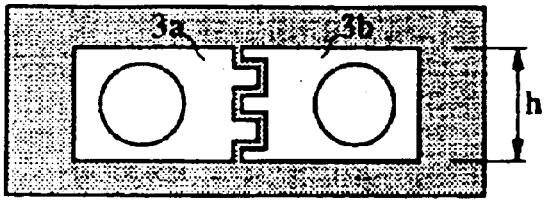
FIG. 9C Prior Art

The mutually opposing parts of the coupling electrodes 3*a* and 3*b* may be arranged in comb-like forms as shown in FIG. 9C. This is a way of providing the opposing parts of the coupling electrodes 3*a* and 3*b* with sufficient length. As a result, as compared with the conventional filter, electrode patterns formed with high accuracy are not needed. Thus, with a high yield rate, dielectric filters can be produced with little variation in their characteristics.

Figure 6A:
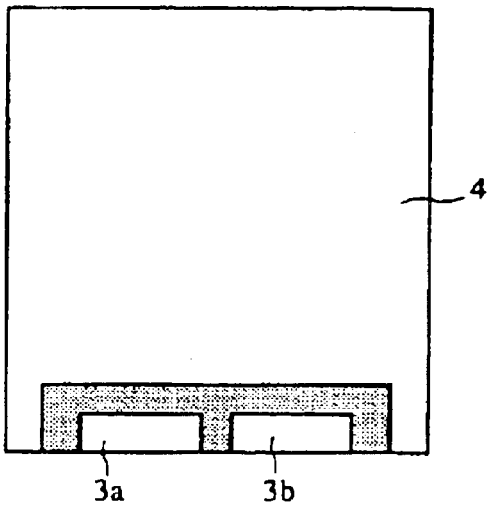
FIGS. 6A to 6D show four surface views illustrating a dielectric filter according to a fifth embodiment of the invention.
Figure 6B:
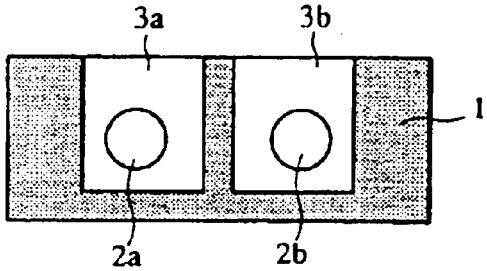
Figure 6C:
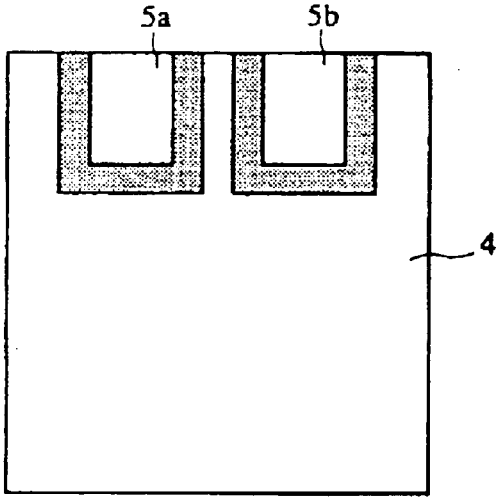
Figure 6D:
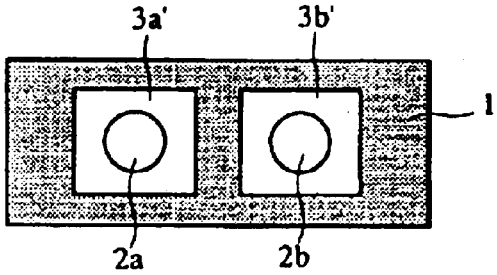

Next, FIGS. 6A to 6D show four surface views of a dielectric filter according to a fifth embodiment of the invention. FIG. 6A shows a top view of the filter, FIG. 6B shows a front view of the filter, FIG. 6C shows a bottom view of the filter, and FIG. 6D shows a back view of the filter. In this embodiment, inside a substantially rectangular parallelepiped dielectric block 1, there are arranged inner-conductor-formed holes 2*a* and 2*b* in which inner conductors are formed on the inner surfaces thereof. In addition, coupling electrodes 3*a* and 3*b* are extended from one open end surface of the holes 2*a* and 2*b* onto a side surface of the dielectric block 1. On the other open end surface of the holes 2*a* and 2*b*, there are arranged coupling electrodes 3*a*' and 3*b*'. On the bottom surface of the dielectric block 1, that is, on a surface used when mounting the filter on a substrate (not shown), there are arranged input/output electrodes 5*a* and 5*b*. In addition, on outer surfaces (four surfaces) of the dielectric block 1, an outer conductor 4 is arranged in positions away from the coupling electrodes 3*a*, 3*b*, 3*a*' and 3*b*', and the input/output electrodes 5*a* and 5*b*.

The dielectric filter shown in each of FIGS. 6A to 6D serves as a dielectric filter in which ½ wavelength resonators, each of which has open-circuited ends, are coupled with each other. In this embodiment, the coupling electrodes 3*a* and 3*b* are extended along one open end surface of the inner-conductor-formed holes of the dielectric block to the adjacent side surface of the dielectric block. Alternatively, the coupling electrodes may be extended from both open end surfaces of the holes to the adjacent side surface thereof.

In this manner, when the coupling electrodes are disposed at both open ends of the holes, the coupling range can be broadened.

Figure 7A:
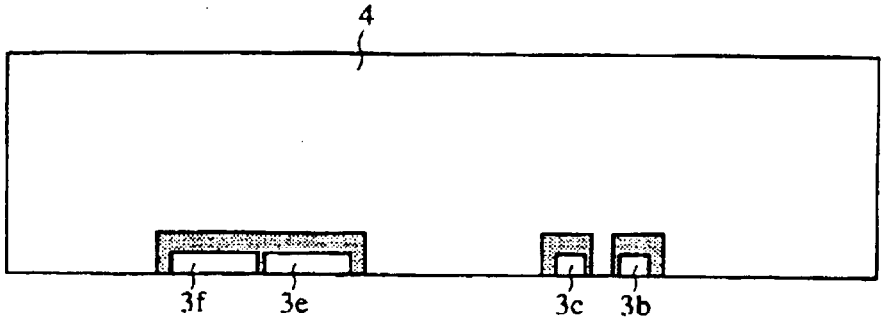
FIGS. 7A to 7C show three surface views illustrating a dielectric duplexer according to a sixth embodiment of the invention.
Figure 7B:
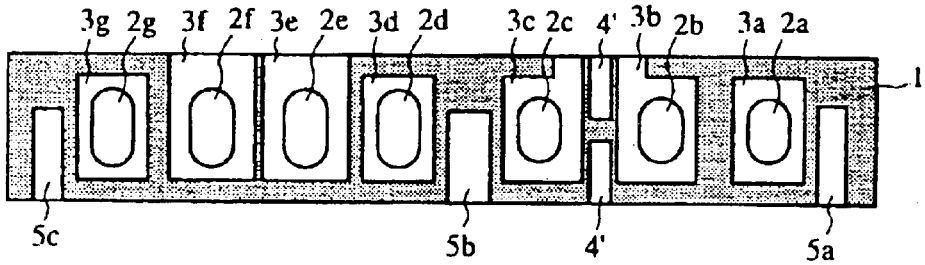
Figure 7C:
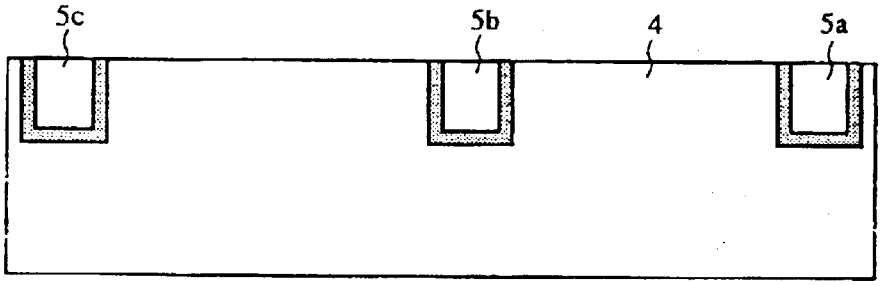

Next, FIGS. 7A, 7B, and 7C show three surface views of a dielectric duplexer according to a sixth embodiment of the invention. In this case, FIG. 7A shows a top view of the duplexer, FIG. 7B shows a front view of the duplexer, and FIG. 7C shows a bottom view of the duplexer. Inside a substantially rectangular parallelepiped dielectric block 1, there are formed inner-conductor-formed holes 2*a* to 2*g* in which inner conductors are formed on the inner surfaces thereof. On the front surface of the dielectric block 1 which contains the open ends of the inner-conductor-formed holes 2*a* to 2*g*, there are formed coupling electrodes 3*a* to 3*g* connected respectively to the inner conductors. Of these coupling electrodes, the coupling electrodes 3*b*, 3*c*, 3*e*, and 3*f* are extended onto the upper surface (a side surface parallel to the axes of the inner-conductor-formed holes) of the dielectric block. In addition, input/output electrodes 5*a*, 5*b*, 5*c* are arranged extending from the front surface of the dielectric block 1 to the bottom surface thereof. Furthermore, outer conductors 4' are disposed between the coupling electrodes 3*b* and 3*c*. Also, an outer conductor 4 is formed on the outer surfaces (five surfaces) of the dielectric block 1 except the open end face on which the coupling electrodes 3*a* to 3*g* are arranged.

Resonators formed by the inner-conductor-formed holes 2*a* and 2*b* shown in FIGS. 7A to 7C are capacitively coupled with each other by the capacitance between the coupling electrodes 3*a* and 3*b*. Two resonators formed by the inner-conductor-formed holes 2*b* and 2*c* are inductively coupled with each other by the outer conductors 4' arranged between the coupling electrodes 3*b* and 3*c*. Four resonators formed by the inner-conductor-formed holes 2*d* to 2*g* are capacitively coupled with each other by capacitances generated between the coupling electrodes 3*d* to 3*g*. Furthermore, by a capacitance generated between the input/output electrode 5*a* and the coupling electrode 3*a*, the input/output electrode 5*a* is capacitively coupled with a resonator formed by the inner-conductor-formed hole 2*a*. Similarly, the input/output electrode 5*c* is capacitively coupled with a resonator formed by the inner-conductor-formed hole 2*g*. Additionally, the input/output electrode 5*b* is capacitively coupled with resonators formed by the inner-conductor-formed holes 2*c* and 2*d*.

In this duplexer, the three resonators formed by the inner-conductor-formed holes 2*a* to 2*c* constitute a transmission filter and the four resonators formed by the inner-conductor-formed holes 2*d* to 2*g* constitute a reception filter. The input/output electrode 5*a* is used as a transmission-signal input terminal, the input/output electrode 5*b* is used as an antenna terminal, and the input/output electrode 5*c* is used as a reception-signal output terminal.

Figure 8:
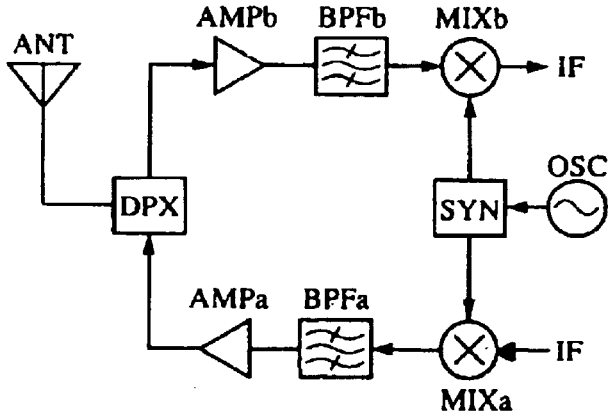
FIG. 8 shows a block diagram of a communication apparatus according to a seventh embodiment of the invention.

Next, with reference to FIG. 8, a description will be given of a communication apparatus according to a seventh embodiment of the invention. In FIG. 8, the reference character ANT denotes a transmission/reception antenna, the reference character DPX denotes a duplexer, and the reference characters BPFa and BPFb denote band pass filters. The reference characters AMPa and AMPb denote amplifying circuits, the reference characters MIXa and MIXb denote mixers, the reference character OSC denotes an oscillator, and the reference character SYN denotes a frequency synthesizer.

The MIXa mixes modulation signals IF with signals output from the SYN. Of the signals mixed and output by the MIXa, the BPFa passes only the signals of a transmission frequency band and the AMPa amplifies the signals to transmit from the ANT via the DPX. The AMPb amplifies reception signals output from the DPX. Of the reception signals output from the AMPb, the BPFb passes only the signals of a reception frequency band. The MIXb mixes frequency signals output from the SYN with the reception signals to output intermediate frequency signals IF.

The duplexer shown in FIG. 8 is the duplexer having the structure shown in FIGS. 7A to 7C. In addition, the band pass filters BPFa, BPFb, and BPFc, are the dielectric filters shown in FIGS. 1A and 1B to FIGS. 6A to 6D.

As described above, in the dielectric filter of the invention, a large capacitance can be generated between the coupling electrodes. Accordingly, even when reducing the height of the entire filter, since the resonators are mutually coupled with great strength and accuracy, desired filter characteristics can be obtained easily.

Furthermore, with the above arrangement of the input/output electrodes, in the state in which the input/output electrodes are connected to the electrodes on a mounting circuit board, electrode patterns on the circuit board do not influence the coupling between the resonators inside the dielectric block. Accordingly, even after the electrodes are mounted on the circuit board, desired filter characteristics can be maintained.

In addition, with the use of the compact dielectric filter or the compact dielectric duplexer, the communication apparatus of the invention can also be miniaturized entirely.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric filter comprising:

a dielectric block;

a plurality of conductive through holes arranged in the dielectric block, each of the conductive through holes having an open end along a first surface of the dielectric block;

a respective single coupling electrode connected to each conductive through hole, each coupling electrode formed on the first surface of the dielectric block and extended at least to a first edge of the dielectric block, the coupling electrodes having a common and continuous, non-conductive gap therebetween shared by the respective coupling electrodes and generating a capacitance therebetween so as to couple the plurality of conductive through holes; and an outer conductor arranged on outer surfaces of the dielectric block.

2. A dielectric filter comprising:

a dielectric block;

a plurality of conductive through holes arranged in the dielectric block, each of the conductive through holes having an open end along a first surface of the dielectric block;

a respective coupling electrode connected to each conductive through hole, each coupling electrode formed on the first surface of the dielectric block and extended at least to a first edge of the dielectric block, the coupling electrodes having a common and continuous, non-conductive gap therebetween shared by the respective coupling electrodes and generating a capacitance therebetween so as to couple the plurality of conductive through holes; and an outer conductor arranged on outer surfaces of the dielectric block, wherein the coupling electrodes further extend onto a second surface of the dielectric block which intersects the first edge of the dielectric block.

3. A communication apparatus comprising a high-frequency circuit and, connected thereto, the dielectric filter according to one of claims 1 and 2.

4. A dielectric filter comprising:

a dielectric block;

a plurality of conductive through holes arranged in the dielectric block, each of the conductive through holes having an open end along a first surface of the dielectric block;

a respective single coupling electrode connected to each conductive through hole, each coupling electrode formed on the first surface of the dielectric block and extended at least to a first edge of the dielectric block, the coupling electrodes having a common and continuous, non-conductive gap therebetween shared by the respective coupling electrodes and generating a capacitance therebetween so as to couple the plurality of conductive through holes;

an outer conductor arranged on outer surfaces of the dielectric block; and input/output electrodes arranged on a second surface of the dielectric block and extending from a second edge, opposing the first edge, to generate capacitances between the open ends of the conductive through holes and the input/output electrodes.

5. A dielectric duplexer comprising a pair of dielectric filters according to claim 4, one input/output electrode of one filter being usable as a transmission-signal input electrode, one input/output electrode of the other filter being usable as a reception-signal output electrode, and the other respective input/output electrodes of both filters being connected together and to an antenna-connecting electrode.

6. A communication apparatus comprising a high-frequency circuit and, connected thereto, the dielectric duplexer according to claim 5.

7. A dielectric filter comprising:

a dielectric block;

a plurality of conductive through holes arranged in the dielectric block, each of the conductive through holes having a open end along a first surface of the dielectric block;

a respective coupling electrode connected to each conductive through hole, each coupling electrode formed on the first surface of the dielectric block and extended at least to a first edge of the dielectric block, the respective coupling electrodes having a gap therebetween and generating a capacitance therebetween so as to couple the plurality of conductive through holes; and an outer conductor arranged on outer surfaces of the dielectric block; and input/output electrodes arranged on a third surface of the dielectric block and extending from a second edge, opposing the first edge, to generate capacitances between the open ends of the conductive through holes and the input/output electrodes, wherein the coupling electrodes further extend onto a second surface of the dielectric block which intersects the first edge of the dielectric block.

* * * * *